US007265081B2

(12) United States Patent
Fregonese et al.

(10) Patent No.: US 7,265,081 B2
(45) Date of Patent: Sep. 4, 2007

(54) DETERGENT COMPOSITION COMPRISING A BLEACH AND AN EDIBLE OIL

(75) Inventors: Daniele Fregonese, Ludwigshafen (DE); Chris Efstathios Housmekerides, Ludwigshafen (DE); Marcus Richter, Luwigshafen (DE)

(73) Assignee: Reckitt Benckisder N.V., NZ Hoofddorp (NL)

( * ) Notice: Subject to any disclaimer, the term of this patent is extended or adjusted under 35 U.S.C. 154(b) by 0 days.

(21) Appl. No.: 10/512,744

(22) PCT Filed: May 12, 2003

(86) PCT No.: PCT/GB03/01960

§ 371 (c)(1),
(2), (4) Date: Jan. 18, 2005

(87) PCT Pub. No.: WO03/095602

PCT Pub. Date: Nov. 20, 2003

(65) Prior Publication Data

US 2005/0119145 A1 Jun. 2, 2005

(30) Foreign Application Priority Data

| | | |
|---|---|---|
| May 11, 2002 | (GB) | 0210815.7 |
| Jun. 18, 2002 | (GB) | 0213971.5 |
| Jun. 25, 2002 | (GB) | 0214631.4 |
| Jul. 16, 2002 | (GB) | 0216458.0 |

(51) Int. Cl.
*C11D 3/395* (2006.01)
*C11D 3/382* (2006.01)

(52) U.S. Cl. ..... 510/220; 510/367; 510/372; 510/375; 510/379; 510/380; 510/381; 510/463; 134/25.2

(58) Field of Classification Search ..... 510/220, 510/367, 372, 375, 379, 380, 381, 463; 134/25.2
See application file for complete search history.

(56) References Cited

U.S. PATENT DOCUMENTS

| | | | | |
|---|---|---|---|---|
| 5,472,482 A | | 12/1995 | Willitts et al. | 106/2 |
| 5,646,101 A | | 7/1997 | MacBeath | 510/220 |
| 5,695,679 A | * | 12/1997 | Christie et al. | 252/186.26 |
| 5,710,115 A | * | 1/1998 | Patel et al. | 510/224 |
| 5,776,874 A | * | 7/1998 | MacBeath et al. | 510/220 |
| 5,780,408 A | | 7/1998 | Russell et al. | 510/200 |
| 6,410,500 B1 | * | 6/2002 | Haerer et al. | 510/445 |

FOREIGN PATENT DOCUMENTS

| | | |
|---|---|---|
| EP | 1 167 506 A | 1/2002 |
| WO | WO93/07086 | 4/1993 |
| WO | WO95/19132 A1 | 7/1995 |
| WO | WO96/33259 A | 10/1996 |

OTHER PUBLICATIONS

International Search Report dated Aug. 12, 2003 for Application No. PCT/GB03/01960.
International Preliminary Examination Report dated Jul. 2, 2004 for Application No. PCT/GB02/01960.

* cited by examiner

*Primary Examiner*—Charles Boyer
(74) *Attorney, Agent, or Firm*—Norris McLaughlin & Marcus PA

(57) ABSTRACT

The present invention relates to a process of removing coloured stains from plastic by treating the substrate in an automatic dishwashing machine with an aqueous liquor comprising a hydrophobic component having a density in the range of 0.06 to 1 gram $cm^3$.

15 Claims, No Drawings

DETERGENT COMPOSITION COMPRISING A BLEACH AND AN EDIBLE OIL

The present invention relates to a process of removing coloured stains from plastic by treating the substrate in an automatic dishwashing machine with an aqueous liquor comprising a hydrophobic component having a density of from 0.6 to 1 g/cm$^3$.

Automatic dishwashing detergents (ADD) used for washing tableware (i.e. glassware, china, silverware, pots and pans, plasticware, etc.) in the home or institutionally in machines especially designed for the purpose have long been known. The particular requirements of cleaning tableware and leaving it in a sanitary, essentially spotless, residue-free state has resulted in so many particular ADD compositions that the body of art pertaining thereto is now recognised as quite distinct from other cleaning product art.

There is an area where dish-cleaning products still fail to deliver the perfect results that the users of ADD products have come to expect from these products. This area is namely the cleaning of plastic, which have been stained by coloured soils coming from their contact with food. In effect, it has been observed that some coloured foods when left in more or less prolonged contact with plastic, can stain the plastic and that these stains are very stubborn and cannot be completely removed with conventional ADD products. Examples of plastic surfaces, which get stained by coloured food, are plastic containers for food (i.e. Tupperware® items), plastic dishes and plastic elements of the dishwasher.

It has surprisingly been observed by the experts in the field that, although the food ingredients responsible for the staining are normally bleached effectively by strong oxidants in solution (i.e. sodium hypochlorite bleaches), once they have caused a stain in plastic the stain is no longer bleachable with the strong oxidants.

Some solutions have been proposed in the art to improve the removal of food coloured stains from plastic in dishwashing machines. These solutions are based on the use of very strong oxidants. One example of such an oxidant is described in PCT application number 95/19132 A1 where it is proposed to use diacyl or tetraacyl peroxides as bleaching species to enhance the removal of bleachable food soils from plastic.

This solution presents however a number of drawbacks. One of the major drawbacks when using not only diacyl or tetraacyl peroxides but also other strong oxidants is the limited compatibility of these ingredients with bleach sensitive ingredients which are desirable in ADD formulations (i.e. enzymes, perfumes, etc.). As a consequence it is normally necessary to take special measures to assure the stability of the formulation comprising both the strong oxidants and the bleach sensitive ingredients. Examples of such measures are the segregation of the incompatible ingredients in different phases of the formulations (i.e. in different regions of a tablet), coating one of the ingredients or maintaining it in an isolated state (i.e. by insolubilisation in a liquid matrix) to reduce its interaction with the rest of the formulation.

Another drawback of using diacyl or tetraacyl peroxides (and also other strong oxidants) is their lack of stability at high temperatures for which reason it has been proposed in WO 93/07086 that they are used in the form of their clathrates with urea or that they are formulated by forming particles with a stabilizing additive (EP 0 796 317 B1).

Still another drawback of diacyl peroxides is that when used in dishwashing processes at their conventional granulometry of 400 to 700 microns, a problem of residue formation occurs as reported by EP 0 821 722 B1. According to this document the alternative of using diacyl peroxides of smaller particles size incorporated into granular detergent compositions will generate segregation problems.

Due to the above mentioned difficulties an unmet need remains to find alternative ingredients which are capable of delivering a good performance in relation with the removal of coloured food stains from plastic, when the dishwashing detergent comprising them are used to treat the stained plastic in an automatic dishwashing machine. It would also be an additional advantage that the alternative ingredients be fully compatible with the conventional detergent ingredients (i.e. with ingredients incompatible with oxidants) and thus could be easily incorporated into dishwashing detergent formulations.

The inventors have now surprisingly found that the above-mentioned objectives can be achieved when a composition containing a hydrophobic species having a density less than or equal to water is delivered to washing liquors in a method of treating stained plastic in a dishwashing machine. The composition may be delivered to the washing liquor through the use of a specially formulated additive to be used in addition to conventional dishwashing detergents or in the alternative it can be incorporated in conventional dishwashing detergents or rinse aids.

According to one aspect of the present invention a process of removing coloured stains from plastic is proposed, which is characterised in that the stained plastic is treated with an aqueous liquor comprising a composition including a hydrophobic component having a density of from 0.6 to 1 g/cm$^3$.

It has been found that a composition comprising a hydrophobic component having a density of from 0.6 to 1 g/cm$^3$ is particularly effective at removing coloured stains (particularly coloured food stains such as those caused by tomatoes) from plastic. Without wishing to be bound by theory it is proposed that in use, the hydrophobic component liberates the food stain from the plastic, then by virtue of the low density of the hydrophobic component (in comparison to a typical wash liquor) the hydrophobic component floats on the wash liquor, taking the stain with it. The stain is thus effectively distanced from the article being cleaned.

Although it is within the scope of the presence invention to use the hydrophobic component at any desired level which achieves the desired peroxide value, it has been observed that a concentration in the washing or rinsing liquor comprised between 15 and 1000 PPM is normally enough to improve the removal of coloured food soils comprising natural dyestuffs from plastic substrates. The degree of improvement is of course influenced by a number of factors like the length and temperature of the washing or rinsing process and/or the composition of the detergent used in conjunction with the component.

It is preferred that the density of the hydrophobic component is in the range of 0.65 to 0.95 g/cm$^3$, more preferably of 0.7 to 0.92 g/cm$^3$, more preferably 0.75 to 0.92 g/cm$^3$, more preferably 0.8 to 0.92 g/cm$^3$, more preferably 0.85 to 0.92 g/cm$^3$, more preferably 0.85 to 0.87 g/cm$^3$.

Most preferably the process is performed in an automatic dishwasher.

It has been observed that the hydrophobic component should not be too viscous as otherwise it may not be effectively discharged during operation of the dishwasher. Preferably the viscosity of the hydrophobic component is less than 300 cp, more preferably between 50 to 250 cp, more preferably between 75 to 150 cp and most preferably from 95 to 100 cp.

The hydrophobic material preferably has one or more of the following characteristics:

a) It is inert b) It is apolar c) It is compatible with bleach and other ingredients used in dishwashing compositions.

Preferred hydrophobic components include hydrocarbon oils and edible oils such as vegetable and/or nut oils such as olive oil, sunflower oil, maize oil, rape oil, soya oil, peanut oil, meadofoam seed oil, linseed oil, walnut oil, sesame oil and thistel oil. Mixtures of more than hydrophobic component may be used.

Most preferably the hydrophobic component is paraffin oil (a hydrocarbon having a boiling range of 140 to 300° C.—otherwise known as kerosene). Paraffin oil has been shown to display excellent compatibility with other detergent components, especially bleach. Other similar hydrocarbons (and substituted hydrocarbons) such as $C_5$–$C_{20}$ aliphatic hydrocarbons are also considered to be suitable in this application.

It has been observed that although the hydrophobic component in itself is able to deliver good performance in the removal of coloured stains from plastic, the presence of bleach increases its efficiency. It is proposed that the bleach is able to act on the stain after liberation by the hydrophobic component when the hydrophobic component is floating on the wash liquor.

Thus, in particularly preferred embodiments of the present invention the aqueous liquor used in the stain removing process of the present invention comprises a bleach in addition to the hydrophobic component. The bleach is preferably an organic or inorganic oxidising material such as those which are conventionally used in detergents. Preferred examples of bleaches include; chlorinated bleaches such as sodium hypochlorite or dichloroisocyanurate, hydrogen peroxide; inorganic peroxides such as percarbonates, perborates, persulfates; organic peroxides such as diacyl, and tetraacyl peroxides; and peracids such as diperoxyazelaic acid. The bleach may be used in combination with a bleach activator.

It is a preferred execution of the present invention that the bleach is present in the aqueous liquor at a concentration of at least 15 PPM.

It has also been found that particularly good results are obtained when the ratio of the hydrophobic component to bleach in the aqueous liquor is between 4:1 and 1400:1.

It is particularly advantageous that, at the same time that coloured stains are removed from plastic, other cleaning tasks are also performed (i.e. removal of proteinic or starchy stains) both on plastic substrates and on other items optionally present in the dishwashing machine (i.e. china, dishware, glassware, cutlery, etc.). It is advantageous that the composition is added to the washing liquor in the dishwasher in a single composition (complete detergent with stain removal capacity) or alternatively as a separate product (being added as a stain removal booster) together with a conventional detergent.

In one embodiment of the present invention the composition may be added to the rinse liquor (either alone or in combination with conventional rinse ingredients) during the rinse cycle in a dishwashing machine.

In an alternative embodiment the composition may be used in a pre-wash and/or main wash cycle in addition to/as an alternative to being used in the rinse cycle. It is also contemplated to use the composition as a pre-treater, namely the composition may be used to treat a soiled article before it is added to a dishwashing machine.

The composition may comprise a thickener so that the composition is in the form of a paste/gel. It is understood that such viscous gels/pastes are pleasing to consumers yet are easily dispersed in solution to provide good cleaning results. Suitable examples of thickeners include polyacrylates, xanthan gum and silica (the latter two thickeners being especially suitable for high ionic strength aqueous solutions).

According to a second aspect of the present invention there is provided an automatic dishwashing detergent composition comprising at least 0.5% w/w of a hydrophobic component having a density in the range of 0.6 to 1.0 g/cm$^3$.

It will be appreciated that details described above in reference to the first aspect of the invention shall apply mutatis mutandis to the second and third aspects of the invention.

The composition preferably further comprises a bleach.

The composition may comprise a complete dishwashing detergent. As dishwashing detergents are normally dosed at levels comprised between 15 and 120 grams per washing cycle and dishwashers employ an average of 5 to 10 liters of water per washing cycle this results in a concentration of detergent ranging from 3,000 to 12,000 ppm. As a consequence a detergent with at least 0.5% w/w of a hydrophobic component having a density in the range of 0.6 to 11.0 g/cm$^3$ provides an aqueous liquor for treating plastic having a concentration of that component of at least 15 ppm.

When the compositions is formulated as a complete dishwashing detergent composition, it preferably includes a number of conventional detergent ingredients such as those belonging to the classes of surfactants, builders, bleaches, bleach activators or bleach catalysts, enzymes, solvents, fillers, tarnishing or corrosion controlling ingredients, perfumes and dyes.

Preferred surfactants include citric acid and citrate.

The composition may comprise an additive to be used in combination with a conventional detergent formulation.

The additive composition, essentially intended to improve stain removal from plastic, may be used to provide additional benefits such as softening of dried-on or burnt-on food or boosting the performance of the detergent composition in any other performance area. To this effect it is foreseen that the additive composition may contain other ingredients selected from the group comprising builders, solvents, enzymes and other conventional ingredients of normal use in dishwashing compositions.

The additive composition generally includes a higher amount of hydrophobic component. Preferably the amount of hydrophobic component is at least 2% w/w.

It is hereby further contemplated to use the composition as a machine cleaner (such as a dishwasher cleaner).

The dishwasher cleaning composition may be used as a pre-treater, i.e. before the machine is operated or alternatively in one or more of the dishwasher cleaning programs.

The present invention is further illustrated with reference to the following non-limiting Examples Method of Evaluation of Coloured Food Soil Removal:

A method for the evaluation of coloured food soil removal from plastic has been developed and is used to evaluate the results obtained with the process and compositions of the present invention and to compare them with the results obtained with conventional dishwashing compositions and processes.

The evaluation method consist in the following steps:

Preparation of stained plastic articles

Washing of the stained articles in dishwasher.

Colorimetric assessment of the degree of stain removal.

Preparation of Standard Soiled Plastic Articles:

Commercially available plastic containers made of isotactic polypropylene, as offered in the US market by Curver-Rubbermaid®, where washed twice in a Bosch SGS5602 machine with water of 2° of German hardness at 55° C. using a Calgonit Powerball® tablet dishwashing detergent.

The reflectance ($R_0$) of the washed containers was measured with a spectrophotometer (Mahlo® color guide 45/0).

The same containers were subsequently washed twice in the same dishwasher and under identical conditions but replacing the detergent by 50 g of Ketchup (Rantomato®) and the reflectance of the stained containers ($R_i$) was measured again with the same apparatus.

Method of Stain Removal:

The compositions were evaluated using a dishwasher (GE Quiet Power 3®) and both the pre-wash cycle and the main wash cycle run with water at 55° C. The soiled containers where placed vertically (with their mouth looking to the side) on the lower rack of the dishwasher and the compositions to be tested where dosed in the corresponding pre-wash and main wash compartments of the machine. After the completion of the machine program the stained containers where taken out of the machine and the reflectance ($R_f$) of the base of the containers was determined using a spectrophotometer (Mahlo® color guide 45/0).

The parameter TSRI (tomato stain removal index) was calculated using the following formula:

$$TSRI = \frac{Ro - Rf}{Ro - Ri} * 100$$

A perfect stain removal is characterised by a treated article having a reflectance as high as that of the unstained original article and thus a TSRI of 100. An article were no stain removal had been achieved would show a reflectance identical to that of the stained container and thus a TSRI of 0.

EXAMPLES

Example 1

To evaluate the performance of compositions according to the invention in comparison with state-of-the art compositions, a base gel dishwashing detergent was used for both pre-wash and wash cycles and to this base detergent a different hydrophobic component was added as shown in Table I.

Containers, which had been stained with tomato, as described above were washed in a dishwasher (GE Quiet Power 3®) using a certain amount of gel dishwashing detergent (as indicated in column C) for the pre-wash cycle and a different amount of detergent was used in the main wash cycle (indicated in column D).

TABLE I

| A Hydrophobic Component | B Detergent in pre-wash cycle (g) | C Detergent in main wash cycle (g) | D Hydrophobic Component added to pre-wash (g) | E NaOCl added to pre-wash (g) | F NaOCl added to main wash (g) | G Soil removal (%) |
|---|---|---|---|---|---|---|
| Paraffin | 45 | 60 | 8 | 0.22 | 0.36 | 67 |
| Olive Oil | 45 | 60 | 8 | 0.22 | 0.36 | 62 |
| Soya Oil | 45 | 60 | 8 | 0.22 | 0.36 | 60/63 |

These results clearly show that addition of a hydrophobic component greatly enhances removal of tomato stains on plastic. Furthermore paraffin exhibits the greatest enhancement.

The invention claimed is:

1. A method of enhancing the removal of coloured food stains from plastic substrates during an automatic dishwashing process which method comprises the step of:

contacting coloured food stains present on the plastic substrates with a composition comprising an edible oil as a hydrophobic component having a density of from 0.6–1 gram/cm$^3$ and a bleach to enhance the removal of the coloured stains from the plastic substrates wherein the ratio of the hydrophobic component to the bleach component is between 16.67:1 and 1400:1.

2. The method according to claim 1, wherein the density of the hydrophobic component is in the range of 0.65–0.95 grams cm$^3$.

3. The method according to claim 1 wherein the viscosity of the hydrophobic component is less than 300 cp.

4. The method according to claim 1 wherein the concentration of the hydrophobic component in the washing liquor is between 15 and 10000 ppm.

5. The method according to claim 1 wherein the edible oil is olive oil, sunflower oil, maize oil, rape oil, soya oil, peanut oil, meadowfoam seed oil, linseed oil, walnut oil, sesame oil, thistle oil or a mixture thereof.

6. The method according to claim 1, wherein the composition comprises more than 10 ppm of bleach.

7. The method according to claim 1 wherein the composition comprises at least 0.5% w/w of a hydrophobic component having a density in the range of 0.6 to 1 gram cm$^3$.

8. The method according to claim 2, wherein the density of the hydrophobic component is in the range of 0.7–0.92 grams cm$^3$.

9. The method according to claim 8, wherein the density of the hydrophobic component is in the range of 0.75–0.92 grams cm$^3$.

10. The method according to claim 9, wherein the density of the hydrophobic component is in the range of 0.8–0.92 grams cm$^3$.

11. The method according to claim 10, wherein the density of the hydrophobic component is in the range of 0.85–0.92 grams cm$^3$.

12. The method according to claim 10, wherein the density of the hydrophobic component is in the range of from 0.85–0.87 grams cm$^3$.

13. The method according to claim 3, wherein the viscosity of the hydrophobic component is between 50–250 cp.

14. The method according to claim 13 wherein the viscosity of the hydrophobic component is between 75 to 1.50 cp.

15. The method according to claim 14, wherein the viscosity of the hydrophobic component is between 95 to 100 cp.

* * * * *

UNITED STATES PATENT AND TRADEMARK OFFICE

CERTIFICATE OF CORRECTION

PATENT NO. : 7,265,081 B2
APPLICATION NO. : 10/512744
DATED : September 4, 2007
INVENTOR(S) : Daniele Fregonese et al.

It is certified that error appears in the above-identified patent and that said Letters Patent is hereby corrected as shown below:

On the title page item (73),
Under the heading "Assignee":
Reckitt Benckis<u>d</u>er N.V., NZ Hoofddorp (NL)

should read:
Reckitt Benck<u>ise</u>r N.V., NZ Hoofddorp (NL)

Signed and Sealed this

Twenty-seventh Day of May, 2008

JON W. DUDAS
*Director of the United States Patent and Trademark Office*